US007322535B2

(12) United States Patent
Erdely

(10) Patent No.: US 7,322,535 B2
(45) Date of Patent: Jan. 29, 2008

(54) FAUCET SPRAY HEAD

(75) Inventor: Edward Erdely, Aliso Viejo, CA (US)

(73) Assignee: Newfrey, LLC, Newark, DE (US)

( * ) Notice: Subject to any disclaimer, the term of this patent is extended or adjusted under 35 U.S.C. 154(b) by 209 days.

(21) Appl. No.: 11/041,785

(22) Filed: Jan. 24, 2005

(65) Prior Publication Data

US 2006/0163387 A1 Jul. 27, 2006

(51) Int. Cl.
*B05B 1/30* (2006.01)
*A62C 31/02* (2006.01)

(52) U.S. Cl. ..... 239/581.1; 239/428; 239/391; 239/393

(58) Field of Classification Search ..... 239/428.5, 239/390, 391, 394, 550, 551, 579, 581.1, 239/581.2, 587.1
See application file for complete search history.

(56) References Cited

U.S. PATENT DOCUMENTS 3,722,799 A 3/1973 Rauh
3,786,885 A 1/1974 Manoogian et al.
3,876,151 A 4/1975 Katva
4,187,986 A 2/1980 Petrovic
4,190,207 A * 2/1980 Fienhold et al. ..... 239/381
4,221,338 A * 9/1980 Shames et al. ..... 239/428.5
4,398,669 A * 8/1983 Fienhold ..... 239/447
4,530,467 A 7/1985 Bueno
4,561,593 A 12/1985 Cammack et al.
4,562,967 A 1/1986 Grothe et al.
4,588,130 A * 5/1986 Trenary et al. ..... 239/381
4,598,866 A 7/1986 Cammack et al.
4,674,687 A * 6/1987 Smith et al. ..... 239/447
4,703,893 A * 11/1987 Gruber ..... 239/391
4,733,818 A 3/1988 Aghnides
4,976,467 A 12/1990 Paige
5,100,055 A 3/1992 Rokitenetz et al.
5,127,580 A 7/1992 Fu-I
5,172,866 A * 12/1992 Ward ..... 239/446
5,213,267 A 5/1993 Heimann et al.
5,246,169 A 9/1993 Heimann et al.
5,344,080 A * 9/1994 Matsui ..... 239/449
5,356,078 A 10/1994 Bischoff
5,398,872 A * 3/1995 Joubran ..... 239/99
5,647,537 A 7/1997 Bergmann
5,697,557 A 12/1997 Blessing et al.
5,730,176 A 3/1998 Heimann et al.
5,765,760 A 6/1998 Kuo
5,860,599 A 1/1999 Lin
5,889,275 A 3/1999 Chen
5,918,816 A 7/1999 Huber
5,957,387 A * 9/1999 Porta et al. ..... 239/312
5,961,046 A * 10/1999 Joubran ..... 239/107

(Continued)

*Primary Examiner*—Kevin Shaver
*Assistant Examiner*—James S. Hogan
(74) *Attorney, Agent, or Firm*—Richard J. Veltman, Esq.; Taylor & Aust, P.C.; Ronald K. Aust, Esq.

(57) ABSTRACT

A faucet spray head for attachment to a faucet spout includes a spout adapter configured for attachment to the faucet spout. The spout adaptor has a body defining an interior chamber. The interior chamber has at least one exit passage. A spray head mechanism is rotatably coupled to the body. The spray head mechanism includes an aeration unit and a spray unit that are individually selected based on a rotational position of the spray head mechanism in relation to the spout adaptor.

18 Claims, 9 Drawing Sheets

U.S. PATENT DOCUMENTS 6,001,250 A 12/1999 Schorn et al.
6,113,010 A 9/2000 Wu-Hsiung
6,341,737 B1 1/2002 Chang
6,367,504 B1 4/2002 Knapp
6,367,710 B2 4/2002 Fan
6,394,133 B1 5/2002 Knapp
6,481,643 B1 11/2002 Chen
6,533,194 B2 * 3/2003 Marsh et al. ..... 239/383
6,568,605 B1 5/2003 Chen
6,607,148 B1 8/2003 Marsh et al.
6,659,372 B2 12/2003 Marsh et al.
6,719,219 B1 4/2004 Wang
2001/0008256 A1 7/2001 Marsh et al.

* cited by examiner

FAUCET SPRAY HEAD

BACKGROUND OF THE INVENTION

1. Field of the invention

The present invention relates to a spray head, and, more particularly, to a spray head for a faucet, such as a kitchen faucet.

2. Description of the related art

A typical faucet, such as a kitchen faucet, includes hot and cold water controllers, and a spout having one end coupled to the controls and another end connected to an aeration head. The aeration head may be formed using a mesh screen defining a matrix of very small pores thorough which the water passes, thereby separating the delivered water stream into a multitude of finely divided streams concentrated in a small area.

In a typical kitchen faucet system, for example, a separate retractable spray hose with a spray nozzle is coupled to the controls as well. Such a spray nozzle typically includes a head having a ring of individual spray nozzles which are positioned and designed to provide a plurality of streams, lesser in number than the multitude of finely divided streams of the aeration head of the faucet, and with each stream having a larger flow volume than an individual stream from the aeration head.

SUMMARY OF THE INVENTION

The present invention provides a faucet spray head having both an aeration unit and spray unit which are individually selectable, for example, via a rotation of a spray head mechanism of the faucet spray head. A selection between an aeration mode and a spray mode may be made, for example, with a relatively small rotational displacement of the spray head mechanism.

The invention, in one form thereof, is directed to a faucet spray head for attachment to a faucet spout. The faucet spray head includes a spout adapter configured for attachment to the faucet spout. The spout adaptor has a body defining an interior chamber. The interior chamber has at least one exit passage. A spray head mechanism is rotatably coupled to the body. The spray head mechanism includes an aeration unit and a spray unit that are individually selected based on a rotational position of the spray head mechanism in relation to the spout adaptor.

The invention, in another form thereof, is directed to a method for operating a faucet spray head attached to a faucet spout, including rotating an outer housing of the faucet spray head in a first rotational direction to select a spray unit for operating the faucet spray head in a spray mode; and rotating the outer housing of the faucet spray head in a second rotational direction opposite to the first rotational direction to select an aeration unit for operating the faucet spray head in an aeration mode.

The invention, in still another form thereof, is directed to a kit for a faucet spray head, including a switching plate having at least one perimeter opening defining a first fluid path and at least one interior opening defining a second fluid path, and a number of interior opening seals equal to or greater than the number of interior openings in the switching plate.

An advantage of the present invention is that it provides a unitary faucet spray head for a faucet, such as a kitchen faucet, that can selectively operate in either of an aeration mode and a spray mode.

Another advantage is that selection between the aeration mode and the spray mode is achieved by a simple rotational displacement of the spray head.

Yet another advantage is that selection between the aeration mode and the spray mode may be achieved by a rotational displacement of the spray head of about 90 degrees or less.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
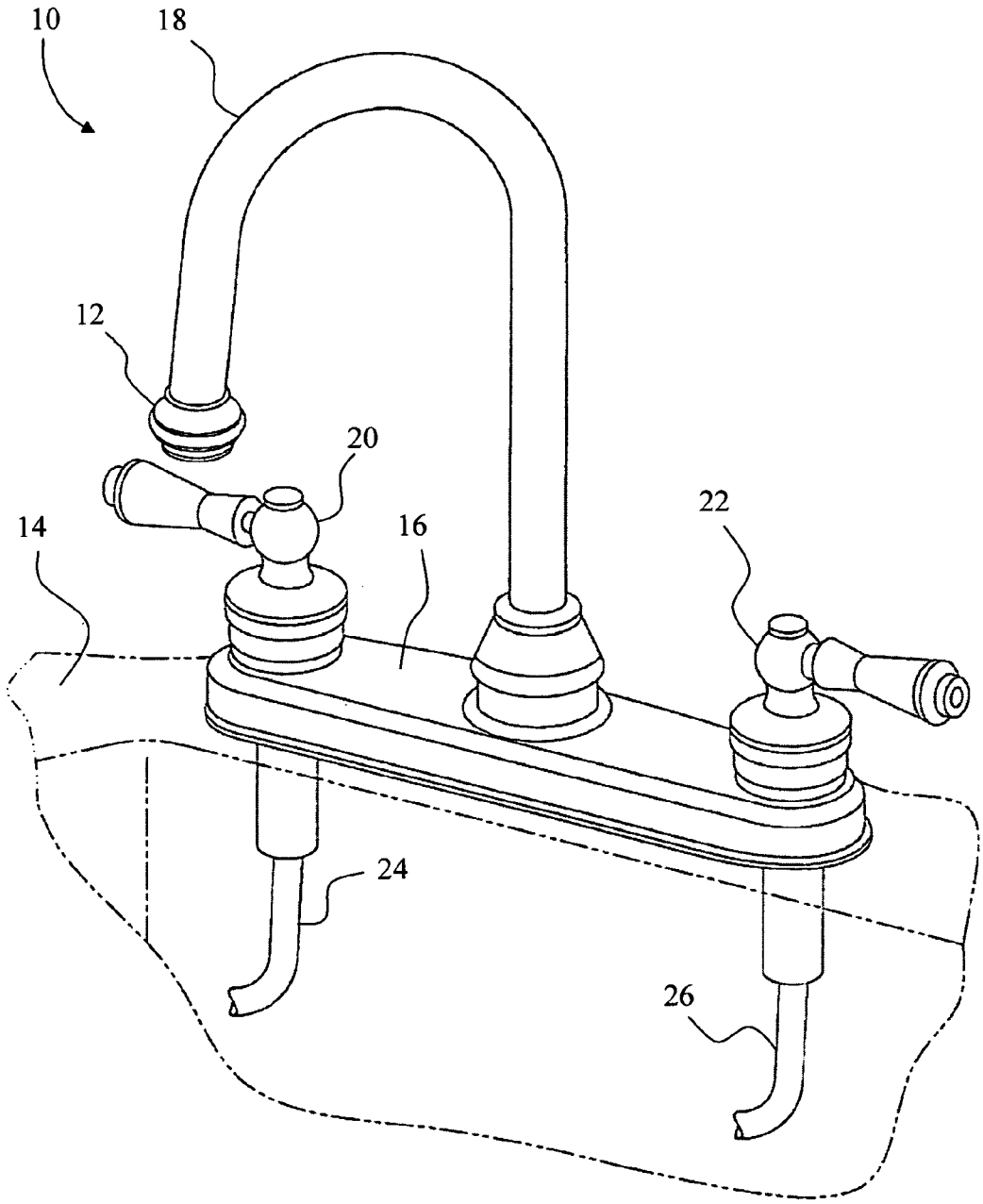
FIG. 1 is a perspective view of a faucet including an embodiment of a faucet spray head in accordance with the present invention.

Referring now to the drawings and particularly to FIG. 1, there is shown a perspective view of a faucet 10 including a faucet spray head 12 configured in accordance with the present invention. Faucet 10 may be mounted, for example, to a kitchen sink 14 as shown, or to other sink structures, such as for example, a utility sink.

Faucet 10 further includes a base 16, a faucet spout 18, a hot water controller 20 and a cold water controller 22. Hot and cold water conduits 24, 26, respectively, such as for example copper pipes, connect faucet 10 to a water source (not shown). Faucet spout 18 is connected at a first end to base 16 and at a second end to faucet spray head 12. Base 16 supplies a flow of water, including hot and/or cold water in proportions as selected by hot water controller 20 and a cold water controller 22, to faucet spray head 12.

Figure 2:
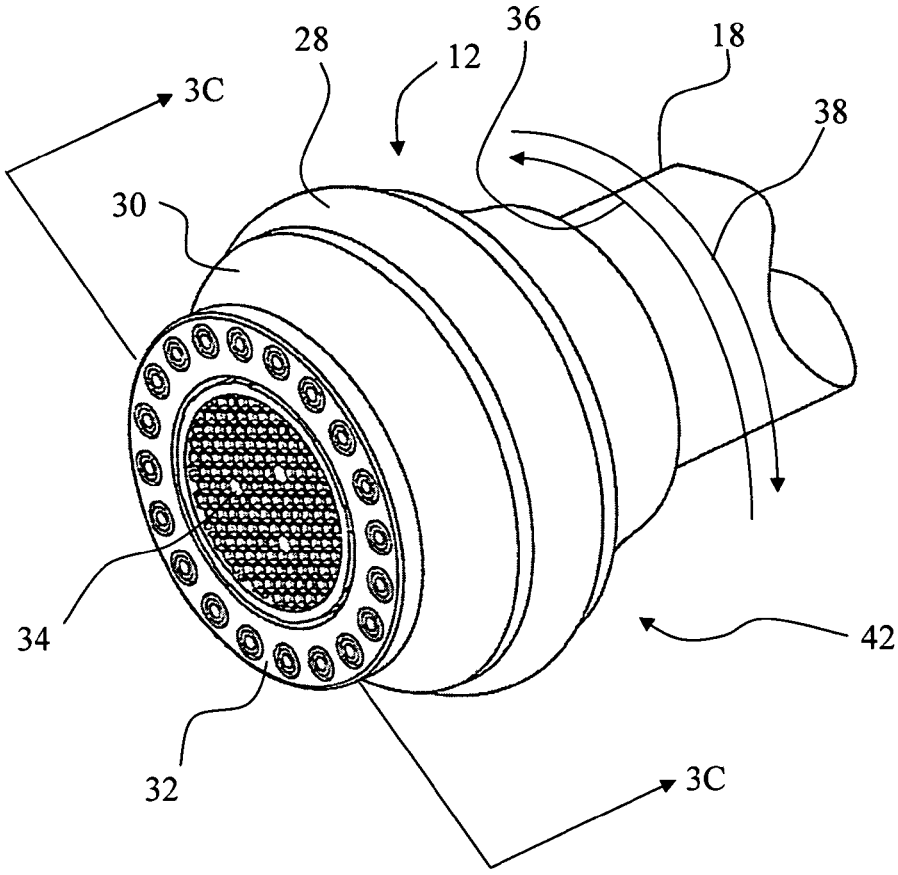
FIG. 2 is a perspective exterior view of one embodiment of the faucet spray head of FIG. 1.

FIG. 2 is a perspective exterior view of one embodiment of faucet spray head 12. As shown, faucet spray head 12 includes an outer housing 28, a housing portion 30, a spray unit 32 and an aeration unit 34. Housing portion 30 is threadably connected to outer housing 28, and retains spray unit 32 and aeration unit 34 in outer housing 28. In general, rotating outer housing 28 of faucet spray head 12 in a first rotational direction 36 selects spray unit 32 for operating faucet spray head 12 in a spray mode. Rotating outer housing 28 of faucet spray head 12 in a second rotational direction 38 opposite to first rotational direction 36 selects aeration unit 34 for operating faucet spray head 12 in an aeration mode.

Figure 3A:
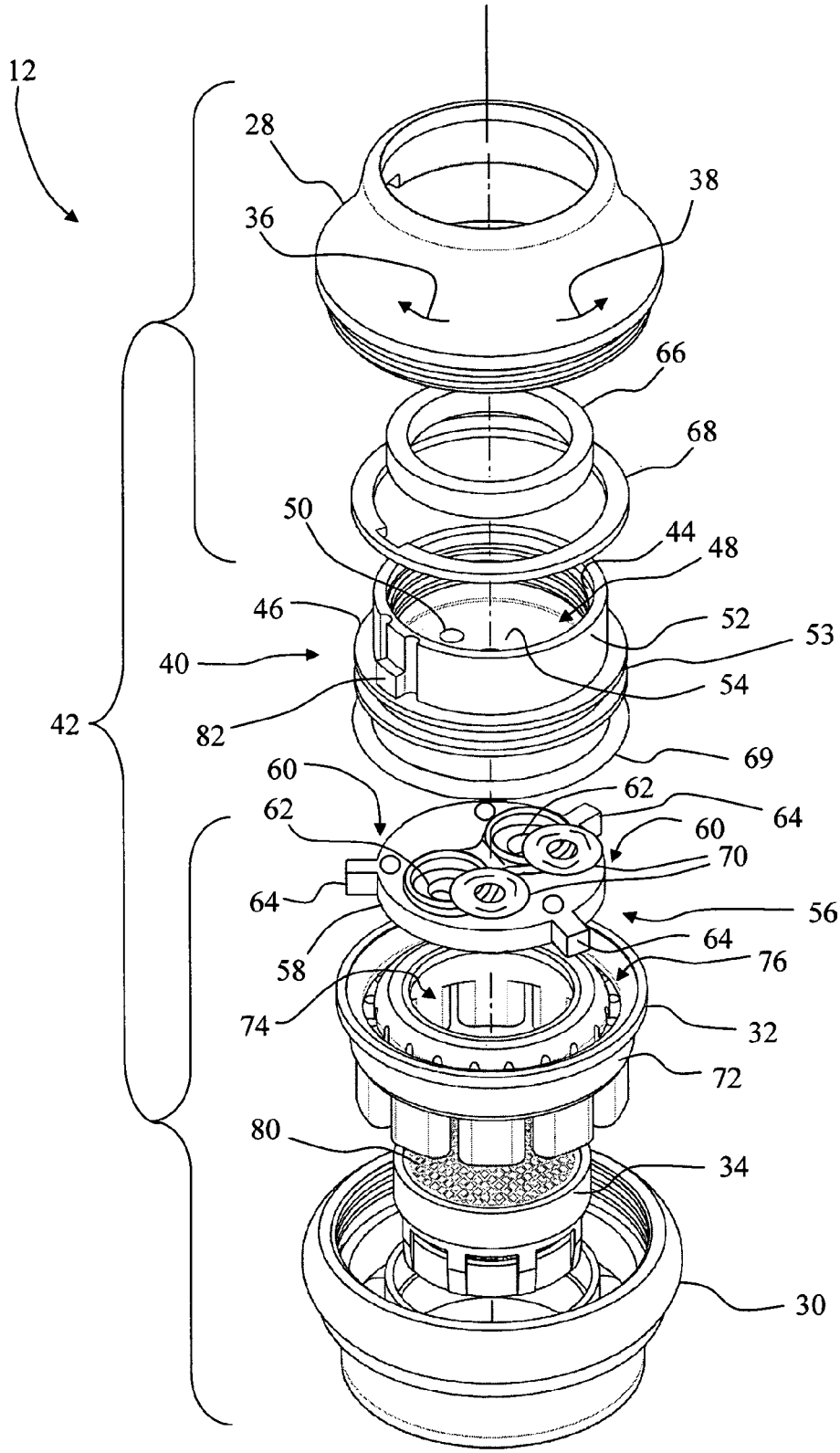
FIG. 3A is a top down exploded perspective view of the faucet spray head of FIG. 2 depicting an arrangement of components when the spray mode is selected.
Figure 3B:
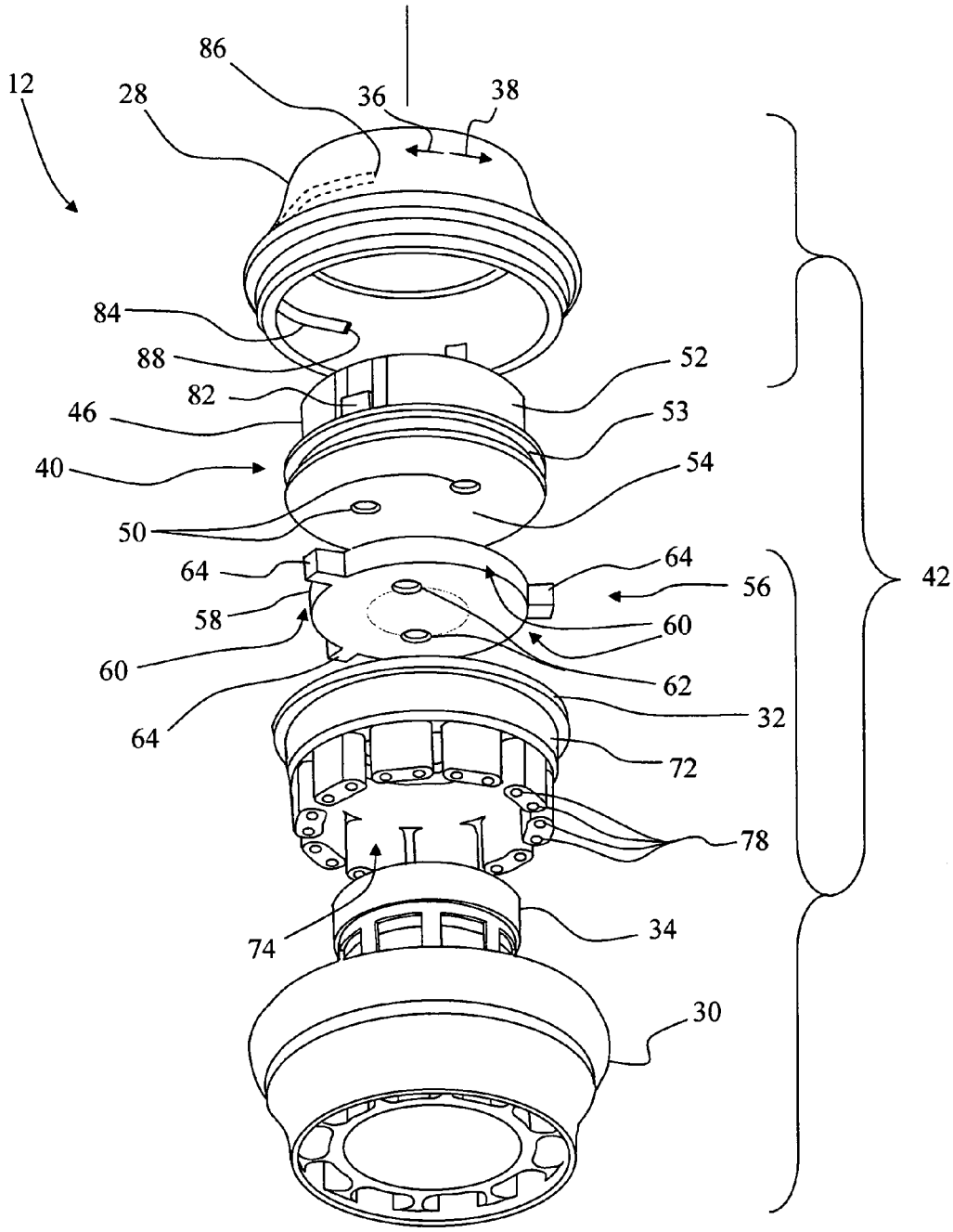
FIG. 3B is a bottom up exploded perspective view of the faucet spray head of FIG. 2 depicting an arrangement of components when the spray mode is selected.
Figure 4A:
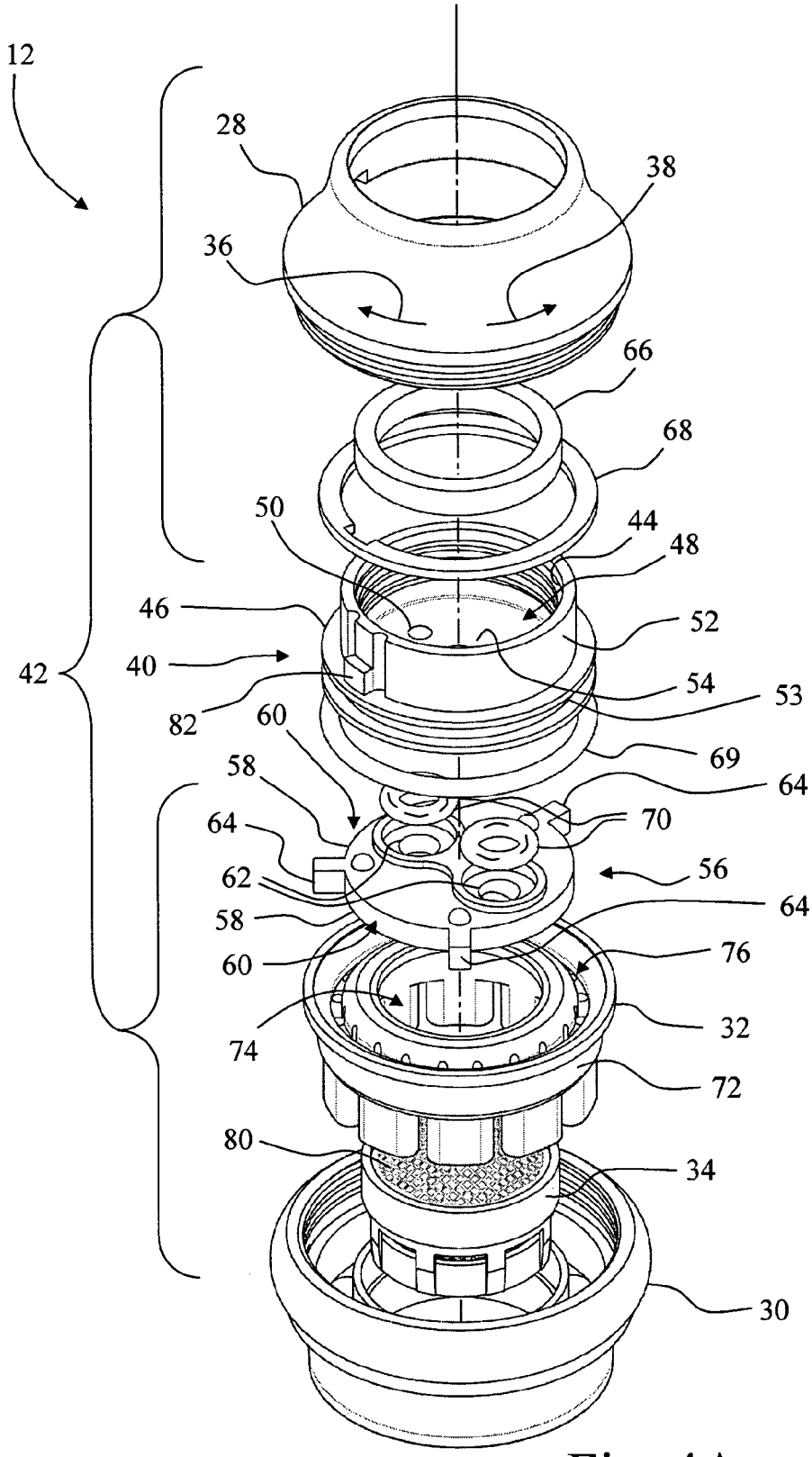
FIG. 4A is a top down exploded perspective view of the faucet spray head of FIG. 2 depicting an arrangement of components when the aeration mode is selected.
Figure 4B:
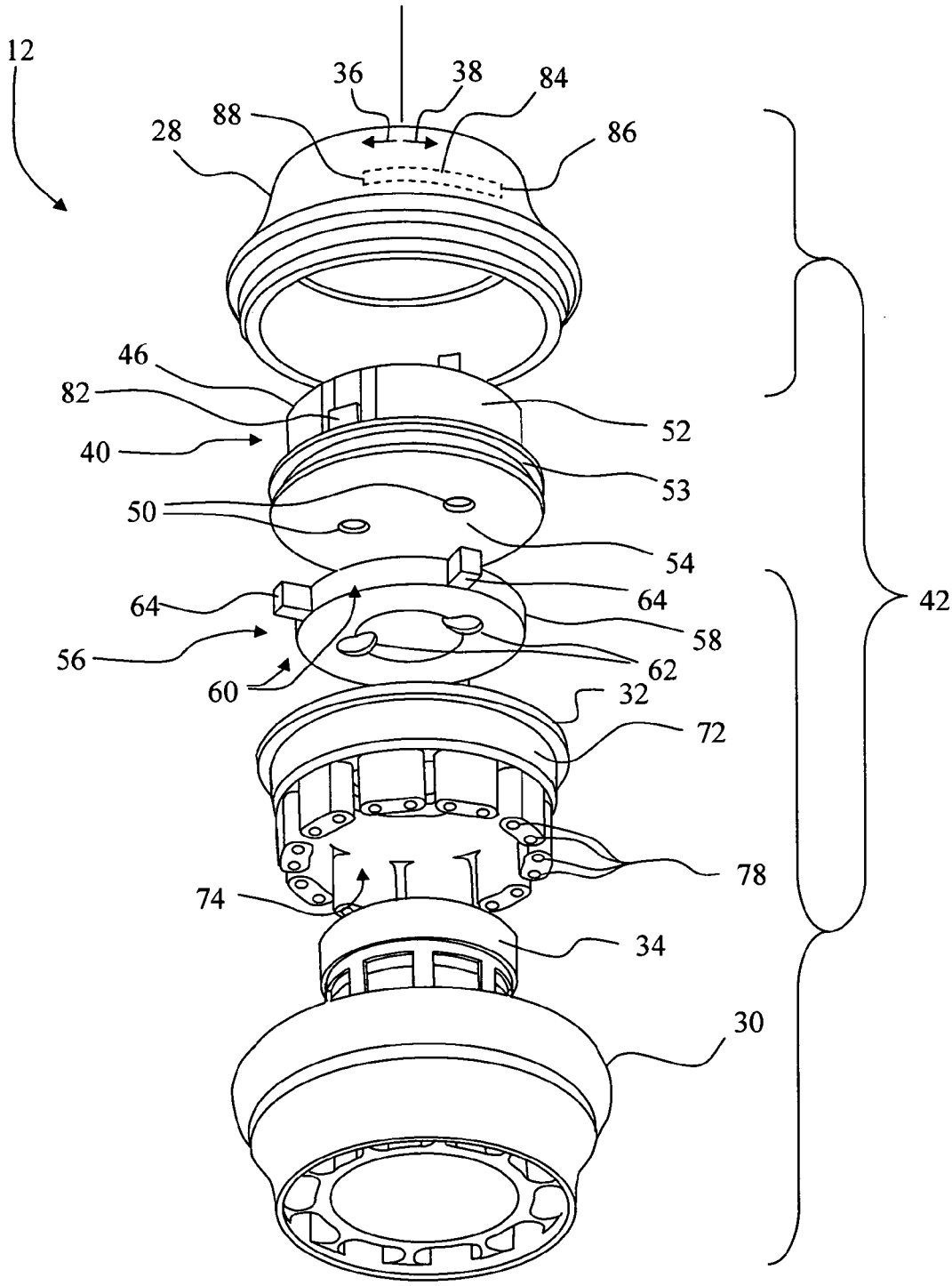
FIG. 4B is a bottom up exploded perspective view of the faucet spray head of FIG. 2 depicting an arrangement of components when the aeration mode is selected.

FIGS. 3A and 3B are exploded perspective views of faucet spray head 12 of FIG. 2 depicting an arrangement of components when the spray mode is selected. FIGS. 4A and 4B are exploded perspective views of faucet spray head 12 of FIG. 2 depicting an arrangement of components when the aeration mode is selected.

Referring to FIGS. 3A, 3B, 4A and 4B, faucet spray head 12 includes a spout adapter 40 and a spray head mechanism 42. Spout adaptor 40 is contained within spray head mechanism 42.

Spout adapter 40 has threads 44 for engaging the threaded end of faucet spout 18. Spout adaptor 40 has a body 46 defining an interior chamber 48 having at least one exit passage 50, e.g., two exit passages 50 in this embodiment. Body 46 of spout adapter 40 includes a cylindrical wall 52 and a base wall 54 attached to cylindrical wall 52 to define interior chamber 48. One or more O-ring grooves 53 may be formed around cylindrical wall 52. The exit passage(s) 50 are formed through base wall 54.

Spray head mechanism 42 is rotatably coupled to body 46 of spout adaptor 40. Spray head mechanism includes outer housing 28, housing portion 30, spray unit 32 and aeration unit 34, as described above. Spray unit 32 and aeration unit 34 are individually selected based on a rotational position of spray head mechanism 42 in relation to spout adaptor 40.

More specifically, spray head mechanism 42 further includes a diverter 56 coupled to outer housing 28 for unitary rotational movement therewith. Outer housing 28 is positioned in sealed rotational engagement with cylindrical wall 52 of spout adapter 40 and diverter 56 is positioned in sealed rotational engagement with base wall 54 of spout adapter 40. Diverter 56 directs a water flow to one of spray unit 32 and aeration unit 34.

Diverter 56 may include, for example, a switching plate 58 having at least one perimeter opening 60 and at least one interior opening 62, e.g., two interior openings 62 in this embodiment. The perimeter opening(s) 60 are defined around a perimeter of switching plate 58 by a plurality of spacer protrusions 64, and more particularly, by the gaps between the spacer protrusions 64. In this embodiment, the number of interior openings 62 corresponds to the number of exit passages 50 in spout adapter 40.

Figure 3C:
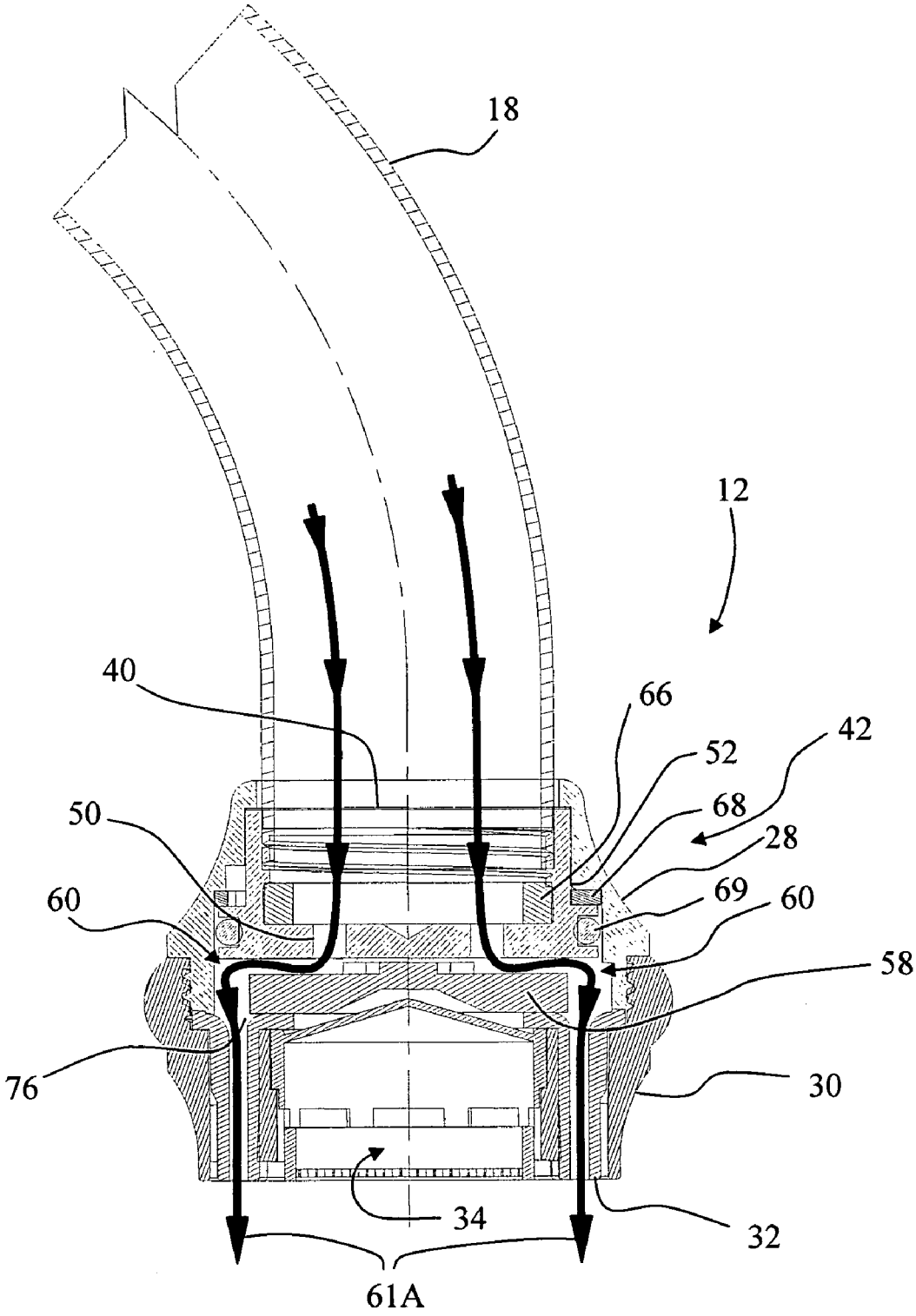
FIG. 3C is section view taken along line 3C-3C of FIG. 2 showing a flow path to the spray unit.
Figure 4C:
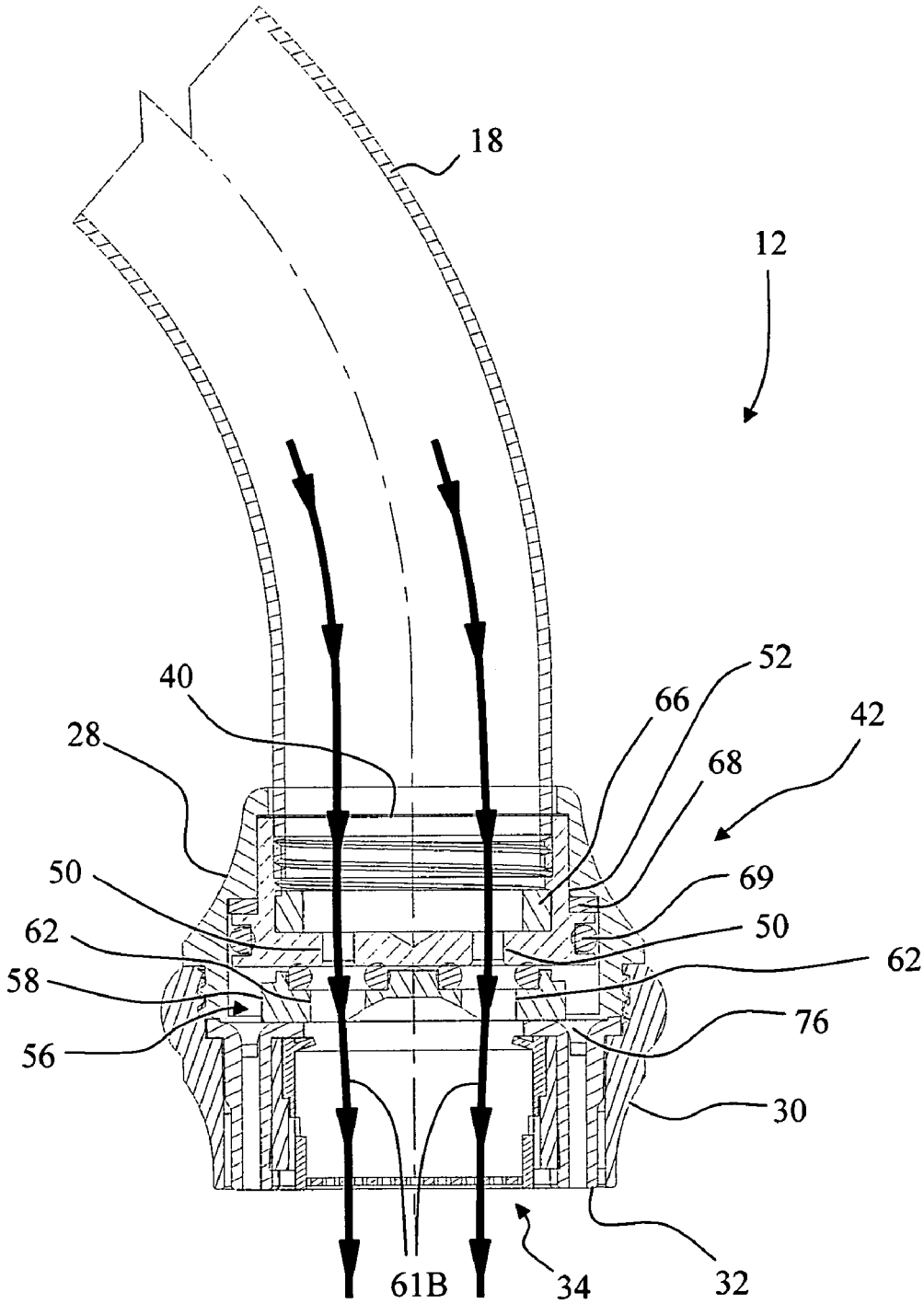
FIG. 4C is section view taken along line 3C-3C of FIG. 2 showing a flow path to the aeration unit.

The perimeter opening(s) 60 define a first water path 61A leading to spray unit 32, as illustrated in FIG. 3C, when the interior opening(s) 62 of switching plate 58 are not positioned in alignment with corresponding exit passages 50 of spout adapter 40. The interior opening(s) 62 of switching plate 58 define a second water path 61B leading to aeration unit 34, as illustrated in FIG. 4C, when the interior opening (s) 62 of switching plate 58 are positioned in alignment with corresponding exit passages 50 of spout adapter 40.

As illustrated in FIGS. 3A, 3C, 4A and 4C, the sealed rotational engagement of outer housing 28 with cylindrical wall 52 of spout adapter 40 is facilitated with the aid of rubber washer 66, friction washer 68 and O-ring 69. The sealed rotational engagement of diverter 56, e.g., switching plate 58, with base wall 54 of spout adapter 40 is facilitated with the aid of respective interior opening seal(s) 70 that surrounds respective interior opening(s) 62 of switching plate 58, and that are positioned between base wall 54 of spout adaptor 40 and switching plate 58.

A kit, such as a repair kit for faucet spray head 12, by be formed that includes switching plate 58 and interior opening seals 70, and if desired, other components of faucet spray head 12 that may be subject to wear and or contamination. A number of the interior opening seals 70 in the kit preferably will be equal to or greater than the number of interior openings 62 in switching plate 58.

As can be best seen in FIGS. 3A and 4A, spray unit 32 includes an annular body 72 defining an opening 74. An annular chamber 76 is formed in annular body 72. A plurality of spray orifices 78, as shown in FIGS. 3B and 4B, lead from annular chamber 76 to a region outside faucet spray head 12 to deliver a spray of water. Aeration unit 34 is positioned in the opening 74 defined by annular body 72 of spray unit 32. Aeration unit 34 includes, for example, a mesh screen 80 that defines a matrix of very small pores thorough which the water passes, thereby separating the delivered water stream into a multitude of finely divided streams concentrated in a relatively small area.

As set forth above, to select spray unit 32 for operating faucet spray head 12 in a spray mode, outer housing 28 of faucet spray head 12, and in turn diverter 56, are rotated in first rotational direction 36 such that the interior opening(s) 62 of switching plate 58 are not positioned in alignment with corresponding exit passages 50 of spout adapter 40. Further, to select aeration unit 34 for operating faucet spray head 12 in an aeration mode, outer housing 28 of faucet spray head 12, and in turn diverter 56, are rotated in second rotational direction 38 opposite to first rotational direction 36 such that the interior opening(s) 62 of switching plate 58 are positioned in alignment with corresponding exit passages 50 of spout adapter 40.

Referring to FIGS. 3B and 4B, spout adaptor 40 may further include a protrusion 82, and outer housing 28 of spray head mechanism 42 may further include a stop channel 84 having a first end 86 and a second end 88. The first end 86 engages protrusion 82 when spray head mechanism 42 is rotated to its full extent in first rotational direction 36 relative to spout adapter 40. The second end 88 engages protrusion 82 when spray head mechanism 42 is rotated to its full extent in second rotational direction 38 relative to spout adapter 40 opposite to first rotational direction 36. Thus, stop channel 84 defines a maximum rotational displacement of spray head mechanism 42, and in turn diverter 56, relative to spout adaptor 40 based on the angular distance between first end 86 and second end 88. Accordingly, a spray position and an aeration position of spray head mechanism 42 are each defined between first end 86 of stop channel 84 and second end 88 of stop channel 84. In the exemplary embodiment shown, the amount of the maximum rotational displacement of spray head mechanism 42 may be, for example, selected to be about 90 degrees. Other maximum rotational displacements are possible, however, by selection of the desired angular distance between first end 86 and second end 88.

Figure 5A:
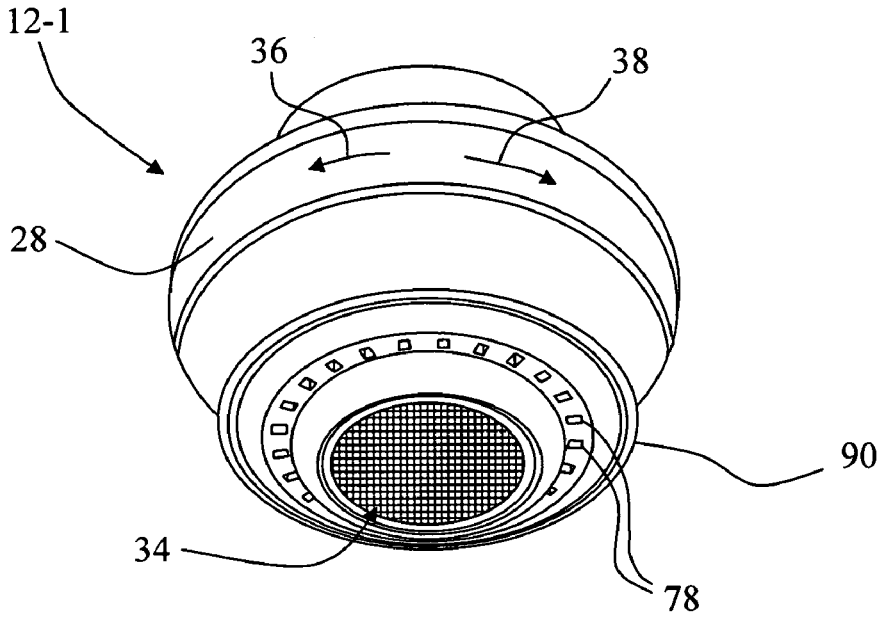
FIGS. 5A and 5B show an alternative to the embodiment of a faucet spray head of FIG. 2, wherein the housing portion is formed integral with the annular body of the spray unit to form an integral spray housing unit.
Figure 5B:
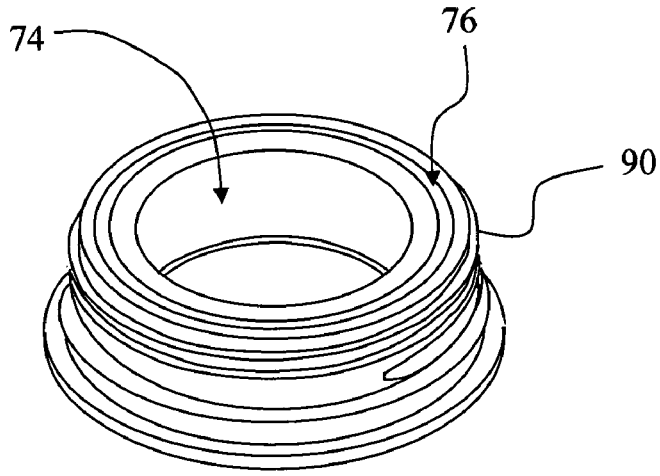

FIG. 5A shows an alternative embodiment of faucet spray head 12, identified as 12-1, wherein housing portion 30 and spray unit 32 as shown in FIGS. 3A, 3B, 4A and 4B are combined into an integral unitary structure. In other words, as shown in FIG. 5B, faucet spray head 12-1 includes an integral spray housing unit 90, formed as a single part, which serves both as the housing portion and the spray unit. Other aspects, operation and the construction of faucet spray head 12-1 will be substantially the same as that described above with respect to faucet spray head 12, and for brevity, will not be repeated here.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A faucet spray head for attachment to a faucet spout, comprising:

a spout adapter configured for attachment to said faucet spout, said spout adaptor having a body defining an interior chamber, said interior chamber having at least one exit passage;

a spray head mechanism rotatably coupled to said body, said spray head mechanism including an aeration unit and a spray unit that are individually selected based on a rotational position of said spray head mechanism in relation to said spout adaptor; and a switching plate having at least one perimeter opening defining a first fluid path and at least one interior opening defining a second fluid path, said switching plate being rotated by said spray head mechanism to select one of said first fluid path and said second fluid path to thereby select said spray unit for operating, and said switching plate being rotated by said spray head mechanism to select the other of said first fluid path and said second fluid path to thereby select said aeration unit for operating.

2. A faucet spray head for attachment to a faucet spout, comprising:

a spout adapter configured for attachment to said faucet spout, said spout adaptor having a body defining an interior chamber, said interior chamber having at least one exit passage; and a spray head mechanism rotatably coupled to said body, said spray head mechanism including an aeration unit and a spray unit that are individually selected based on a rotational position of said spray head mechanism in relation to said spout adaptor, wherein:

said body of said spout adapter includes a cylindrical wall and a base wall attached to said cylindrical wall to define said interior chamber, said at least one exit passage being formed through said base wall; and said spray head mechanism includes an outer housing and a diverter coupled to said outer housing for unitary rotational movement therewith, said outer housing being positioned in sealed rotational engagement with said cylindrical wall of said spout adapter and said diverter being positioned in sealed rotational engagement with said base wall of said spout adapter, said diverter directing a water flow to one of said aeration unit and said spray unit.

3. The faucet spray head of claim 2, wherein said spout adaptor is contained within said spray head mechanism.

4. The faucet spray head of claim 2, wherein said diverter is a switching plate having at least one perimeter opening defining a first water path and at least one interior opening defining a second water path, said sealed rotational engagement with said base wall being provided by a respective seal that surrounds a respective interior opening of said switching plate and that is positioned between said base wall of said spout adaptor and said switching plate.

5. The faucet spray head of claim 4, wherein said first water path leads to said spray unit and said second water path leads to said aeration unit.

6. The faucet spray head of claim 2, wherein:

said spray unit includes an annular body defining an opening, an annular chamber formed in said annular body, and a plurality of spray orifices leading from said annular chamber to outside said faucet spray head; and said aeration unit is positioned in said opening defined by said annular body of said spray unit.

7. The faucet spray head of claim 6, wherein said spray unit includes a housing portion for mounting said annular body, said housing portion being connected to said outer housing.

8. The faucet spray head of claim 6, wherein said spray unit includes a housing portion formed integral with said annular body, said housing portion being connected to said outer housing.

9. A faucet spray head for attachment to a faucet spout, comprising:

a spout adapter configured for attachment to said faucet spout, said spout adaptor having a body defining an interior chamber, said interior chamber having at least one exit passage; and a spray head mechanism rotatably coupled to said body, said spray head mechanism including an aeration unit and a spray unit that are individually selected based on a rotational position of said spray head mechanism in relation to said spout adaptor, wherein:

said spray unit includes an annular body defining an opening, an annular chamber formed in said annular body, and a plurality of spray orifices leading from said annular chamber to outside said faucet spray head;

said aeration unit is positioned in said opening defined by said annular body of said spray unit;

said spout adapter includes a cylindrical wall and a base wall attached to said cylindrical wall to define said interior chamber, said at least one exit passage being formed through said base wall; and said spray head mechanism includes an outer housing and a diverter coupled to said outer housing for unitary rotational movement therewith, said outer housing being positioned in sealed rotational engagement with said cylindrical wall of said spout adapter and said diverter being positioned in sealed rotational engagement with said base wall of said spout adapter, said diverter directing a water flow to one of said aeration unit and said spray unit.

10. The faucet spray head of claim 9, wherein said diverter is a switching plate having at least one perimeter opening defining a first water path and at least one interior opening defining a second water path, said sealed rotational engagement with said base wall being provided by a respective seal that surrounds a respective interior opening of said switching plate and that is positioned between said base wall of said spout adaptor and said switching plate.

11. The faucet spray head of claim 10, wherein said first water path leads to said spray unit and said second water path leads to said aeration unit.

12. A faucet spray head for attachment to a faucet spout, comprising:

a spout adapter configured for attachment to said faucet spout, said spout adaptor having a body defining an interior chamber, said interior chamber having at least one exit passage; and a spray head mechanism rotatably coupled to said body, said spray head mechanism including an aeration unit and a spray unit that are individually selected based on a rotational position of said spray head mechanism in relation to said spout adaptor, said spout adaptor including a protrusion and said spray head mechanism including a stop channel having a first end and a second end, said first end engaging said protrusion when said spray head mechanism is rotated to a full extent in a first rotational direction relative to said spout adapter, and said second end engaging said protrusion when said spray head mechanism is rotated to a full extent in a second rotational direction relative to said spout adapter opposite to said first rotational direction.

13. The faucet spray head of claim 12, wherein said stop channel having said first end and said second end defines a maximum rotational displacement of said spray head mechanism relative to said spout adaptor.

14. The faucet spray head of claim 12, wherein a spray position of said spray head mechanism and an aeration position of said spray head mechanism is defined between said first end of said stop channel and said second end of said stop channel.

15. A method for operating a faucet spray head attached to a faucet spout, comprising:

rotating an outer housing of said faucet spray head in a first rotational direction to position a switching plate having at least one perimeter opening formed on a perimeter of said switching plate defining a first fluid path and at least one interior opening defining a second fluid path to select one of said first fluid path and said second fluid path to thereby select a spray unit for operating said faucet spray head in a spray mode; and rotating said outer housing of said faucet spray head in a second rotational direction opposite to said first rotational direction to select the other of said first fluid path and said second fluid path to thereby select an aeration unit for operating said faucet spray head in an aeration mode.

16. A kit for a faucet spray head, comprising:

a switching plate having a perimeter with at least one perimeter opening located on said perimeter to define a first fluid path and at least one interior opening defining a second fluid path; and a number of interior opening seals equal to or greater than the number of interior openings in said switching plate.

17. The kit of claim 16, further comprising at least one of a spout adaptor, an aeration unit, and a spray unit.

18. The kit of claim 16, wherein said perimeter includes a plurality of spacer protrusions to define said at least one perimeter opening.

* * * * *